United States Patent [19]

Traina

[11] 4,087,049

[45] * May 2, 1978

[54] ABOVEGROUND SPRINKLING DEVICE FOR SPRINKLING SYSTEM

[76] Inventor: Vincent Joseph Traina, 10 Las Tardes Ct., Novato, Calif. 94947

[ * ] Notice: The portion of the term of this patent subsequent to Nov. 2, 1990, has been disclaimed.

[21] Appl. No.: 726,001

[22] Filed: Sep. 23, 1976

Related U.S. Application Data

[63] Continuation-in-part of Ser. No. 641,090, Dec. 15, 1975, abandoned.

[51] Int. Cl.[2] ..... B05B 1/14

[52] U.S. Cl. ..... 239/267; 239/276; 239/567

[58] Field of Search ..... 239/266–269, 239/276, 397, 450, 559, 567

[56] References Cited

U.S. PATENT DOCUMENTS

| | | | |
|---|---|---|---|
| D. 242,144 | 11/1976 | Traina | D23/7 |
| 1,539,331 | 5/1925 | Siemann | 239/559 |
| 2,084,817 | 6/1937 | Lombard | 239/276 X |
| 2,124,551 | 7/1938 | Freidman et al. | 239/567 X |
| 2,469,534 | 5/1949 | Wessels | 239/397 |
| 2,746,792 | 5/1956 | Hough | 239/276 |

*Primary Examiner*—John J. Love

*Attorney, Agent, or Firm*—Owen, Wickersham & Erickson

[57] ABSTRACT

An aboveground sprinkling device for a spinkling system for lawns and gardens. The device has a sprinkler head at the center of its upper surface and has four sockets spaced at ninety-degree intervals around its side edge, all leading in to a central chamber immediately below the sprinkler head. An integral holding spike extends down from the bottom of the sprinkler head, preferably at the center, for holding the sprinkling device in a selected location. The spike is shaped to resist rotation. A set of plugs is provided to close the sockets that are not to be used. A hose or hoses can be secured to any one of the sockets or to several of them or to all of them to incorporate the device in a continuous sprinkler system employing a plurality of these sprinkling devices. The sockets not connected to hoses are plugged.

6 Claims, 9 Drawing Figures

FIG. 6
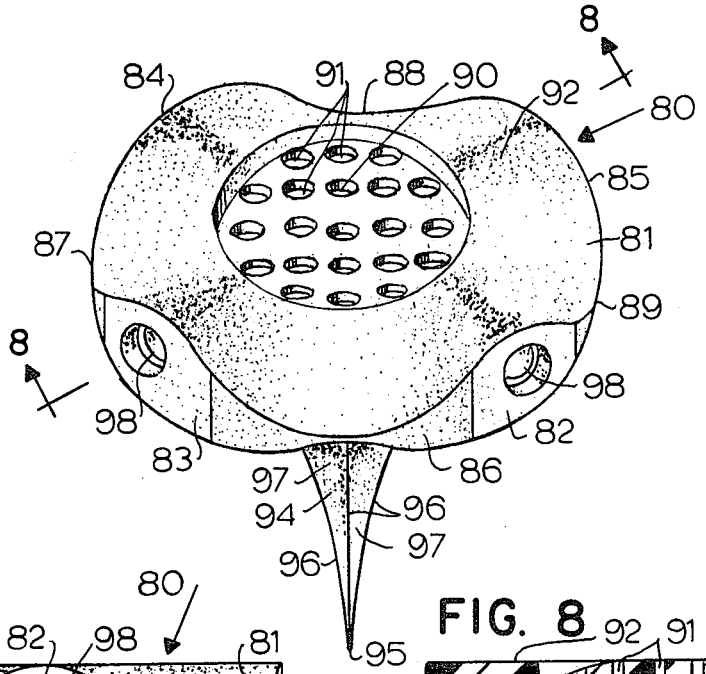
FIG. 7
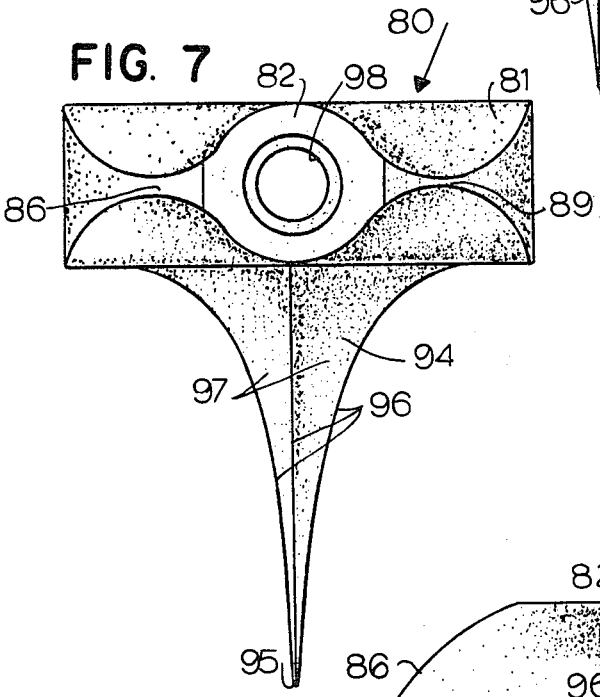
FIG. 8
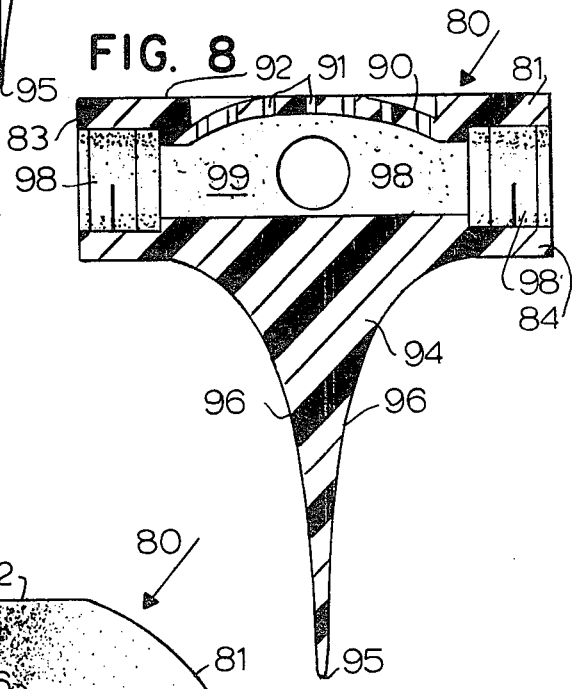
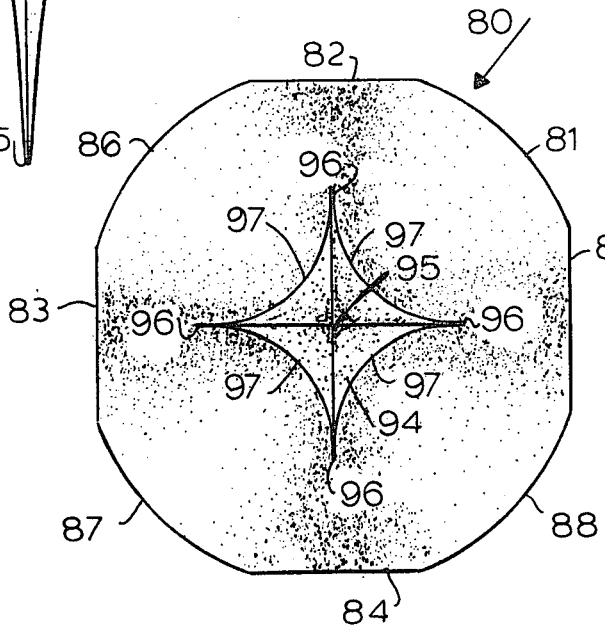
FIG. 9

ABOVEGROUND SPRINKLING DEVICE FOR SPRINKLING SYSTEM

REFERENCE TO RELATED APPLICATION

This application is a continuation-in-part of application Ser. No. 641,090 filed Dec. 15, 1975 now abandoned.

BACKGROUND OF THE INVENTION

This invention relates to an improved sprinkling device for use in lawn and garden sprinkling systems.

Sprinkling systems have in the past usually been installed belowground. The installation has typically been expensive and has often required professional help. The more recent use of plastic piping and of kits enabled home owners to install such systems without having to hire plumbers, but the systems still required extensive digging, and after such a system had once been installed, it could not readily be changed.

The lawn sprinkling heads of underground systems have either had to be sunken below the level of the grass or have required some other arrangement to enable lawn mowing, such as setting each head in a barren circle which is dug out and kept free of grass growth, or having fittings that extend up and have to be removed each time one wishes to mow the lawn.

The present invention makes it possible to have the sprinkling system all aboveground. A system of this invention is easily removed from the area during mowing or lawn use where the system interferes or is unsightly, and it can readily be replaced. The sprinkler head is located aboveground on the lawn when in use. Installation can employ either standard hoses or plastic pipes, whichever are desired by the user, and installation is made extremely simple.

Aboveground sprinkling devices heretofore have consisted mainly of a single sprinkler, whether of a stationary type or of a type that swings or rotates a nozzle or sprinkler head. Such sprinklers have been comparatively inadaptable once acquired. Moreover, the systems designed for underground installation are usually not suitable for use aboveground and tend to look unsightly when used aboveground.

Some aboveground sprinklers were adapted to be used in a linear series, but there was no provision for use over a wide area comparable to that when underground sprinklers were used.

Most aboveground sprinklers have merely rested on top of the surface. This makes it difficult to keep a pattern of them in a series of predetermined locations. The present invention includes means to anchor each sprinkler against both rotary and displacement movement.

Among the objects of the invention are the following: to provide a sprinkling device which is adaptable to an aboveground sprinkling system; to provide a sprinkling device having a retaining means for holding it in a set position; to provide a sprinkling device which can not only be connected to the hose supplying water to it but can also be connected by other hoses to other sprinklers to provide a unitary system to cover a desired area of regular or irregular shape; to provide an attractive sprinkling system which is not unsightly when placed aboveground; to provide immediate adaptability for changing the sprinkler system whenever desired.

SUMMARY OF THE INVENTION

In the present invention the sprinkler has a main housing with top, bottom and side edges. There are four sockets in the side edges, each being threaded or otherwise provided for reception of a suitable nipple and disposed at 90° intervals. All four lead into a central chamber at a crossing which is directly overlain by a dome-like sprinkler head portion which has sprinkler openings for distributing the water in a desired pattern. A holding spike extends downwardly from the bottom of the housing and is shaped for easy installation and for retaining the sprinkling device in place, both against displacement and against rotation. The sprinkling device is provided with a set of threaded plugs for fitting into and closing off such sockets as are not to be connected to hoses or pipes. At the maximum, three plugs would be used when the sprinkler is simply to be connected directly to a single hose or hose portion. Two plugs are used when the sprinkler has a second hose leading outwardly. Only one plug is used when the sprinkling device is connected to three hoses altogether, and when all four sockets are connected to hoses, no plug is used.

A system can readily be built up from hoses and several sprinklers of this type to fit practically any desired pattern, whether for lawn or for garden use.

Other objects and advantages of the invention will appear from the following description of a preferred sprinkler and of a system embodying a plurality of such sprinklers.

BRIEF DESCRIPTION OF THE DRAWINGS

In the drawings:

FIG. 6 is a view in perspective of a modified form of sprinkler unit, also embodying the principles of the invention.

FIG. 7 is a view in side elevation of the unit of FIG. 6.

FIG. 8 is a view in section taken along the line 8—8 in FIG. 6.

FIG. 9 is a bottom view of the same unit.

DESCRIPTION OF TWO PREFERRED EMBODIMENTS

Figure 1:
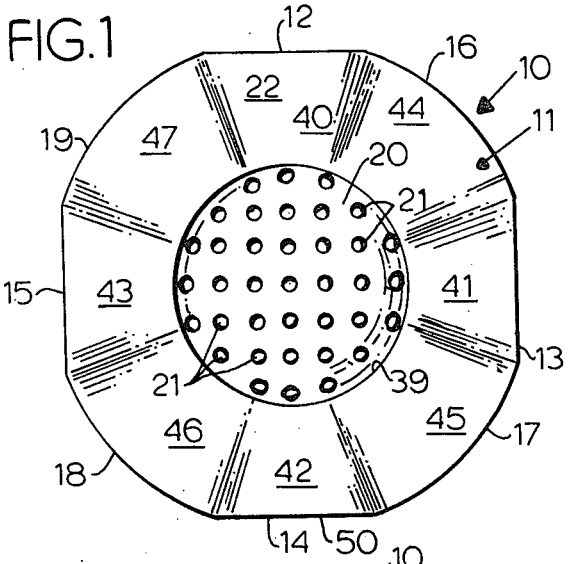
FIG. 1 is a top plan view of a sprinkling device embodying the present invention.
Figure 2:
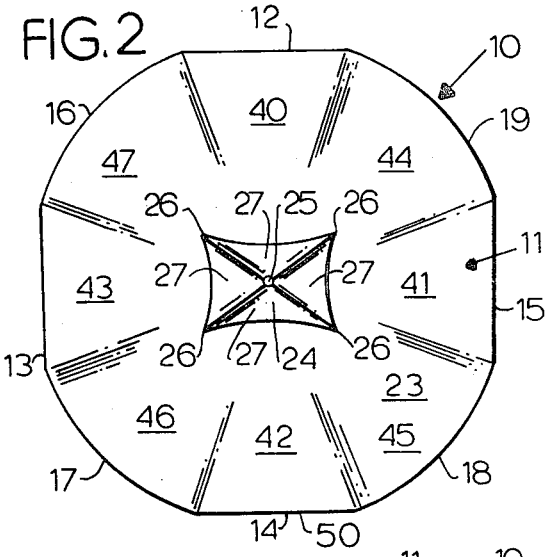
FIG. 2 is a bottom view of the same device.
Figure 3:
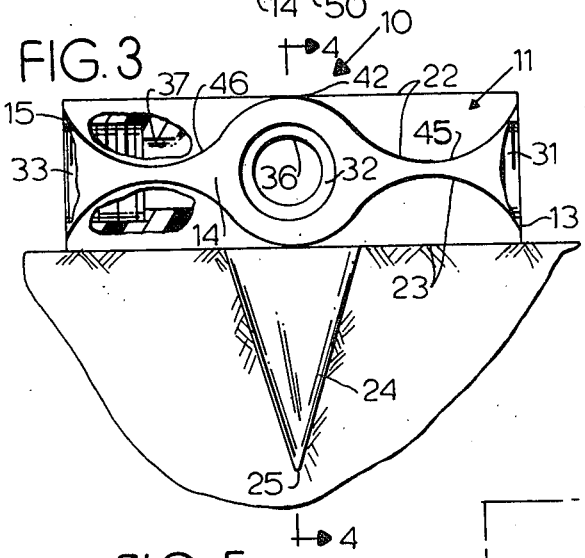
FIG. 3 is a view in side elevation of the same device shown installed on top of the ground with a spike extending into the ground.
Figure 4:
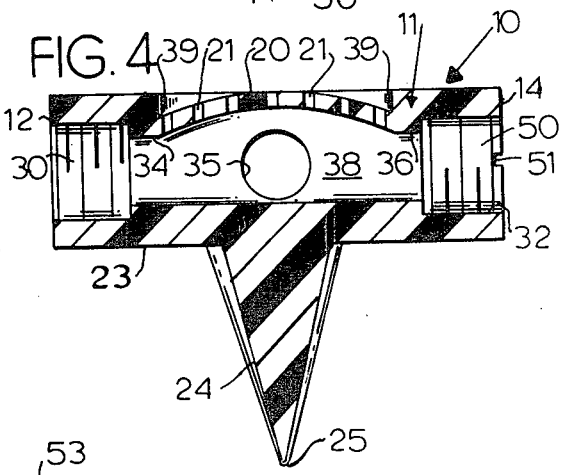
FIG. 4 is a view in section taken along the line 4—4 in FIG. 3.

The embodiment shown in FIGS. 1–4 comrises a sprinkling device 10 having an housing 11. While the housing 11 may be made in various shapes, the one shown is believed to possess advantages. In this instance, it is in the form of what may be considered a combination of an octagon and a circle, having four straight edges 12, 13, 14 and 15 connected together by circular arcs 16, 17, 18 and 19.

The housing 11 has a domelike partially recessed sprinkler portion 20 with upwardly and outwardly extending sprinkler openings 21, surrounded by an annular upper surface 22. The housing 11 also has a bottom surface 23 from which an integral, centrally located suitable ground-anchoring member, such as a spike 24 having a point 25, extends down. Preferably, the spike 24 is provided with four ribs 26, between which the intervening surfaces 27 are concave. This helps to make the side edges 26 sharper and better able to penetrate the ground. It also helps to prevent rotation of the device 10, since the four-sided configuration resists rotation, while a round configuration will not. As shown in the drawings, the upper and lower surfaces 22 and 23 may be shaped rather than simply being flat. This shaping will be better understood after the interior is described.

At each of the straight edges 12, 13, 14 and 15 is a suitable socket 30, 31, 32 or 33, each being threaded to receive a hose (or provided with some other type of attachment means, if desired, such as a bayonet-receiving type of receptacle). Each socket 30, 31, 32, 33 leads by a short conduit 34, 35, 36, 37, into a central chamber 38 underlying the dome 20 at the crossing. Thus, from whatever socket the water enters, it passes directly into the central chamber 38 directly underneath the dome-shaped sprinkling head 20 and sends water out through the sprinkling head 20. As noted, the sprinkling head 20 is preferably somewhat dome-shaped and its outer edges 39 are preferably recessed inwardly so that the head does not stick up too high.

The housing 11 is shaped, preferably as shown to be thicker at portions 40, 41, 42, 43 where the sockets and conduits lie and at the center and to be thinner at portions 44, 45, 46 and 47 in between the conduits.

The provision of four sockets 30, 31, 32, 33, all leading into the central chamber 38 is what makes this sprinkler 10 so adaptable to use in sprinkling systems. It is capable of mass production, either to make all units alike or with different types of sprinkler heads 20, if that is desired. It is possible, then, to install and connect the sprinkling device 10 by any one of its four sockets 30, 31, 32, 33 to a hose, and it is also possible for any one of the remaining sockets to be connected to hoses. A plurality of plugs 50 is provided with each sprinkler 10, usually three plugs being sold with each sprinkler 10. Each plug 50 is capable of being threaded into any one of the sockets 30, 31, 32, 33 (or being installed into them otherwise, if the socket be an other-than-threaded type). Usually a key slot 51 is provided to enable insertion by a screwdriver.

Figure 5:
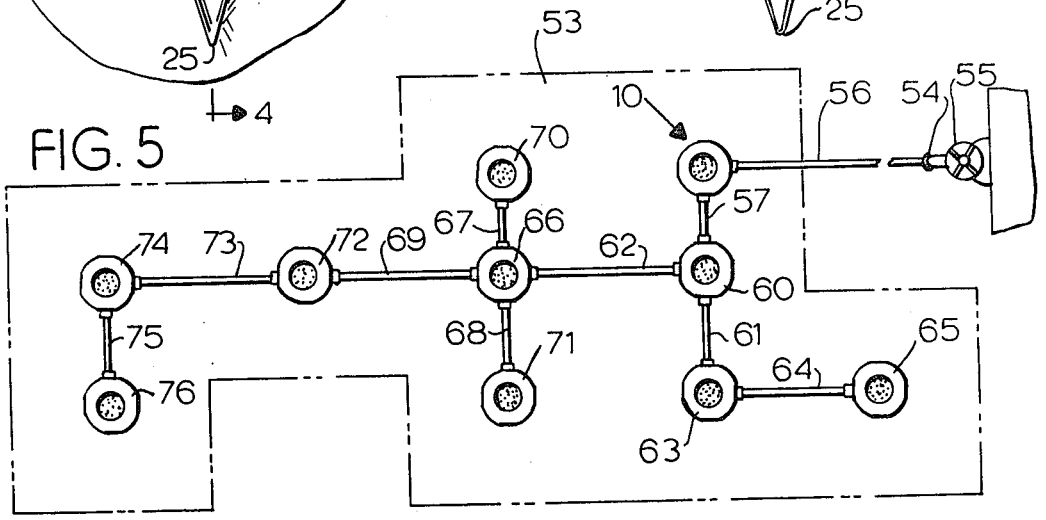
FIG. 5 is a top plan view of a lawn sprinkling system embodying the principles of the invention and using several of the sprinkling devices of FIGS. 1–4.

FIG. 5 illustrates somewhat diagrammatically the way in which several sprinklers like the sprinkler 10 are used in a sprinkling system to cover an area 53. Thus, in this instance, a faucet 54 is shown having a faucet handle 55 for adjusting the flow of water. From the faucet 54 a hose 56 leads to the first sprinkler 10 identical with the sprinkler 10 already described, as will be all of the sprinklers in this system. The hose 56 goes into the socket 31, and a hose 57 is attached to the socket 32. The sockets 30 and 33 are closed by plugs 50.

The hose 57 leads to a sprinkler 60 (identical with the sprinkler 10) where it enters at a socket 30; in this case only one plug 50 is used (to close the socket 31) while the sockets 32 and 33 are attached to hoses 61 and 62. The hose 61 leads to a sprinkler 63, from which a hose 64 leads to a sprinkler 65. The sockets of the sprinklers 63 and 65 to which the hoses 61 and 64 are not attached are plugged.

Similarly the hose 62 leads to a sprinkler 66 which has all of its sockets connected to hoses, respectively hoses 67, 68 and 69. Thus, the hose 67 leads to a sprinkler 70 at which three sockets are plugged, and the hose 68 leads to a sprinkler 71 at which three sockets are plugged. The hose 69 leads to a sprinkler 72 from which a hose 73 leads to a sprinkler 74 which in turn is connected by a hose 75 to a sprinkler 76. This enables watering the systems shown in the drawings as a lawn area 53 having a somewhat unusual area pattern.

An even better embodiment of the invention is shown in FIGS. 6–9, which may also be used in patterns like that shown in FIG. 5. Here, a sprinkling device 80 has a housing 81 having four straight edges 82, 83, 84, and 85 connected by four arcs 86, 87, 88 and 89. A domelike partially recessed sprinkler head 90 has a series of upwardly and outwardly extending openings 91 surrounded by an annular upper surface 92, which is shaped in a rather sinuous, wavelike manner.

From a bottom surface 93, also wavelike, a central spike 94 depends, having a point 95 and four cusp-like sharp edges 96 with somewhat concave surfaces 97 in between. This spike structure is quite important, increasing at once the ease of installation and the resistance to rotation of the installed sprinkler 80.

Four threaded openings 98 are provided, each of which is either connected to a hose or is plugged, as described before. The water enters through any one opening 98 into a domed chamber 99 directly underlying the sprinkler head 90.

The whole device is readily molded as a single piece except for the head 90, which may thereupon be installed. All parts may be made from plastic.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

I claim:

1. A sprinkling device for use aboveground in a ground-hugging sprinkling system for lawns and gardens utilizing garden hoses, including in combination:

a main housing having a top, a bottom, and side edges and providing an interior crossing, with four sockets in said side edges, disposed at ninety-degree intervals, each adapted to receive a nipple, and each leading into an unpartitioned central chamber at the crossing having a domed upper wall, the height of said chamber at its highest portion being equal to or no greater than the diameter of said socket, said upper wall being a sprinkler head directly overlying said crossing and at least partially recessed into said housing, and having upwardly and outwardly extending sprinkling openings directly therethrough, and a holding spike integral with said bottom and extending downwardly, for holding said sprinkling device in place, said spike having four sharp edges, between which lie concave faces, for facilitating installation and for retaining said device in place and against rotary movement.

2. The sprinkling device of claim 1 including a set of three readily removable plugs, each fitting into one said socket to close it off.

3. A sprinkling device for use aboveground in a ground-hugging sprinkling system for lawns and gardens utilizing garden hoses, including in combination:

a generally flat main housing little higher than the diameter of a garden hose and having a top, a bottom, and vertical side edges, four threaded sockets in said side edges disposed at 90° intervals and each leading by a reduced-diameter opening in to an unpartitioned central chamber at the crossing, the height of said central chamber at its highest portion being approximately equal to or no greater than the diameter of the sockets, said top including a partially recessed dome-like sprinkler head directly overlying said central chamber and forming the upper wall thereof with the top of the dome no higher than the remainder of said upper wall and the periphery of the dome sunk down in said upper wall, said dome having upwardly and outwardly extending sprinkling openings therethrough, so that water entering said central chamber directly engages said sprinkling head, and a four-sided holding spike integral with said bottom and extending downwardly, for holding said sprinkling device in place, said spike having four sharp cusp-like edges converging cusp-like at a sharp point, with concave side walls between said edges, the spike thereby facilitating installation and resisting rotary movement when installed.

4. The sprinkling device of claim 3 including a set of three readily removable threaded plugs, each fitting into one said socket to close it off.

5. An aboveground ground-hugging sprinkling system for lawns and gardens, including in combination:

a plurality of easily installable aboveground sprinkling devices, each providing a short main housing having a top, a bottom, and side edges and providing an unpartitioned interior crossing with four sockets in said side edges, said sockets being disposed at 90° intervals, and leading by reduced-diameter openings in to a central chamber at the crossing, the height of said central chamber at its highest portion being approximately equal to or no greater than the diameter of a said socket, said top including a dome-like sprinkler head directly overlying said crossing and providing the upper wall of said central chamber, the periphery of said head being recessed in said top and the high point of the dome no higher than the margin thereof and having upwardly and outwardly directed sprinkling openings therethrough, and an integral holding spike extending downwardly from said bottom, for holding said sprinkling device in place, said spike having four sharp edges between which are concave walls, converging to a sharp point, whereby when the spike is inserted in the ground, said bottom wall is substantially flat on the ground, a plurality of aboveground garden hose sections connected to sockets to connect a first said sprinkler to a source of water and to connect the rest of said sockets to said first said sprinkler, directly or via other said sprinklers, and garden hose sections to provide a pattern of aboveground sprinklers adequate to dispense water evenly over a lawn area, and a plurality of plugs, one fitting into each said socket to which a said hose is not connected.

6. The system of claim 5 wherein said spike's edges are cusp-shaped converging like cusps into a sharp point at the lower end.

* * * * *